US011365915B2

(12) United States Patent
Li et al.

(10) Patent No.: US 11,365,915 B2
(45) Date of Patent: Jun. 21, 2022

(54) EJECTOR AND REFRIGERATION SYSTEM

(71) Applicant: Carrier Corporation, Palm Beach Gardens, FL (US)

(72) Inventors: Sheng Li, Shanghai (CN); Xinyu Wu, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 21 days.

(21) Appl. No.: 16/811,742

(22) Filed: Mar. 6, 2020

(65) Prior Publication Data

US 2020/0292219 A1 Sep. 17, 2020

(30) Foreign Application Priority Data

Mar. 15, 2019 (CN) ..... 201910198775.7

(51) Int. Cl.
*F25B 41/30* (2021.01)
*F25B 5/02* (2006.01)

(52) U.S. Cl.
CPC ..... *F25B 41/30* (2021.01); *F25B 5/02* (2013.01); *F25B 2341/0012* (2013.01); *F25B 2341/0015* (2013.01); *F25B 2400/23* (2013.01)

(58) Field of Classification Search
CPC .... F25B 5/02; F25B 6/04; F25B 41/30; F25B 2341/0012; F25B 2341/001; F25B 2341/0013; F25B 2341/00; F25B 2341/0011; F25B 2341/0014;
(Continued)

(56) References Cited

U.S. PATENT DOCUMENTS 2,044,022 A * 6/1936 Stalcup ..... F25B 1/06 62/170
2,051,185 A * 8/1936 Stalcup ..... F25B 1/06 62/170
2,099,085 A 11/1937 Shrode
(Continued)

FOREIGN PATENT DOCUMENTS

CN 103003643 B 12/2015
DE 112015003818 T5 5/2017
(Continued)

OTHER PUBLICATIONS

Indian Office Action for Application No. 202014008987; dated Nov. 6, 2020; 7 Pages.
(Continued)

*Primary Examiner* — Miguel A Diaz
(74) *Attorney, Agent, or Firm* — Cantor Colburn LLP

(57) ABSTRACT

An ejector and a refrigeration system. The ejector includes: a high-pressure fluid passage extending from a high-pressure fluid inlet to a mixing chamber; a suction fluid passage extending from a suction fluid inlet to the mixing chamber, a first valve being disposed in the suction fluid passage; the mixing chamber, which includes a mixed fluid outlet; and a thermal bulb arranged in the suction fluid passage downstream of the first valve; wherein an elastic diaphragm is disposed in the suction fluid passage, the suction fluid passage is on a first side of the elastic diaphragm, and a closed cavity is on a second side of the elastic diaphragm; the thermal bulb is in communication with the closed cavity, and the thermal bulb and the closed cavity are filled with fluid.

12 Claims, 1 Drawing Sheet

(58) Field of Classification Search
CPC ..... F25B 2341/0015; F25B 2400/23; F25B 9/08; F04F 5/00; F04F 5/04
See application file for complete search history.

(56) References Cited

U.S. PATENT DOCUMENTS

| | | | | | |
|---|---|---|---|---|---|
| 2,702,723 | A * | 2/1955 | MacDougall | F25B 41/31 | 236/98 |
| 3,500,656 | A * | 3/1970 | Coggburn | F25B 41/00 | 62/196.2 |
| 3,670,519 | A * | 6/1972 | Newton | F25B 41/00 | 62/116 |
| 3,701,264 | A * | 10/1972 | Newton | F25B 41/00 | 62/191 |
| 6,782,713 | B2 * | 8/2004 | Takeuchi | B60H 1/3204 | 62/191 |
| 6,858,340 | B2 * | 2/2005 | Sugawara | F04F 5/461 | 429/443 |
| 6,877,339 | B2 * | 4/2005 | Nishijima | F25B 41/00 | 62/500 |
| 7,254,961 | B2 * | 8/2007 | Oshitani | B60H 1/323 | 62/500 |
| 7,779,647 | B2 * | 8/2010 | Takeuchi | F25B 40/00 | 62/500 |
| 7,823,400 | B2 * | 11/2010 | Oshitani | F25B 41/00 | 62/191 |
| 7,980,482 | B2 * | 7/2011 | Lou | F25B 41/31 | 236/92 B |
| 10,077,923 | B2 | 9/2018 | Suzuki et al. | | |
| 11,009,266 | B2 * | 5/2021 | Zha | F25B 41/30 | |
| 2004/0007014 | A1 * | 1/2004 | Takeuchi | F25B 41/00 | 62/500 |
| 2004/0040340 | A1 * | 3/2004 | Takeuchi | B60H 1/3204 | 62/500 |
| 2004/0255611 | A1 | 12/2004 | Nishijima et al. | | |
| 2005/0268644 | A1 * | 12/2005 | Oshitani | F25B 5/00 | 62/500 |
| 2007/0186572 | A1 | 8/2007 | Nishida et al. | | |
| 2009/0013704 | A1 | 1/2009 | Oshitani et al. | | |
| 2009/0045264 | A1 * | 2/2009 | Lou | F25B 41/31 | 236/92 B |
| 2018/0231284 | A1 * | 8/2018 | Prins | F25B 43/006 | |
| 2018/0252440 | A1 * | 9/2018 | Zha | F25B 41/30 | |
| 2018/0283754 | A1 * | 10/2018 | Prins | F25B 1/08 | |
| 2018/0320944 | A1 * | 11/2018 | Prins | F25B 6/02 | |
| 2019/0353413 | A1 * | 11/2019 | Larsen | F25B 1/10 | |
| 2019/0368786 | A1 * | 12/2019 | Newel | F25B 40/02 | |
| 2019/0383308 | A1 * | 12/2019 | Kawamoto | F04F 5/04 | |
| 2020/0003468 | A1 * | 1/2020 | Hollister | F25B 49/02 | |
| 2020/0124330 | A1 * | 4/2020 | Hayes | F25B 5/02 | |
| 2020/0292099 | A1 * | 9/2020 | Li | F16K 17/025 | |

FOREIGN PATENT DOCUMENTS

| | | | | |
|---|---|---|---|---|
| JP | 2005037114 | A * | 2/2005 | F25B 41/00 |
| JP | 2008051499 | A * | 3/2008 | B60H 1/323 |
| JP | 4187055 | B2 * | 11/2008 | F25B 41/00 |
| WO | 2017043336 | A1 | 2/2018 | |
| WO | WO-2018118609 | A1 * | 6/2018 | F25B 41/20 |

OTHER PUBLICATIONS

European Search Report for Application No. 20162527.4; dated Jul. 7, 2020; 6 Pages.

* cited by examiner

EJECTOR AND REFRIGERATION SYSTEM

FOREIGN PRIORITY

This application claims priority to Chinese Patent Application No. 201910198775.7, filed Mar. 15, 2019, and all the benefits accruing therefrom under 35 U.S.C. § 119, the contents of which in its entirety are herein incorporated by reference.

FIELD OF THE INVENTION

The present disclosure relates to a refrigeration system, and more particularly, the present disclosure relates to a refrigeration system with an ejector.

BACKGROUND OF THE INVENTION

In commercial refrigeration systems, especially systems that require a large pressure differential, an ejector is used to improve efficiency. The ejector typically pressurizes a suction fluid by means of a high-pressure fluid and supplies mixed fluids to a compressor inlet, thereby increasing the pressure of fluid at the compressor inlet, reducing the requirements on the capacity of the compressor and improving the efficiency of the system. During the operation of the ejector, if the high-pressure fluid and an outlet fluid flow reversely to an inlet of the suction fluid, a significant loss of compressor efficiency will be caused.

SUMMARY OF THE INVENTION

An object of the present disclosure is to solve or at least alleviate the problems existing in the related art.

According to some aspects, an ejector for use in a refrigeration system is provided, which includes: a high-pressure fluid passage extending from a high-pressure fluid inlet to a mixing chamber; a suction fluid passage extending from a suction fluid inlet to the mixing chamber, a first valve being disposed in the suction fluid passage; the mixing chamber, which includes a mixed fluid outlet; and a thermal bulb arranged downstream of the first valve in the suction fluid passage; wherein an elastic diaphragm is disposed in the suction fluid passage, the suction fluid passage is on a first side of the elastic diaphragm, and a closed cavity is on a second side of the elastic diaphragm; the thermal bulb is in communication with the closed cavity, and the thermal bulb and the closed cavity are filled with fluid; and the elastic diaphragm is associated with the first valve so that the first valve is opened or closed in response to a change in a pressure difference across two sides of the elastic diaphragm.

Optionally, in the ejector, a second valve is disposed in the high-pressure fluid passage, and the second valve is mechanically connected to the first valve so that it is opened or closed in synchronization with the first valve.

Optionally, in the ejector, the high-pressure fluid passage and the suction fluid passage include parallel sections that are parallel to each other, and the first valve and the second valve are respectively disposed in the parallel sections of the suction fluid passage and the high-pressure fluid passage.

Optionally, in the ejector, the elastic diaphragm is connected to a front side of a spool of the first valve, and a back side of the spool of the first valve is supported by a first elastic member; the first elastic member is connected to a housing of the ejector by a first bolt, and the first bolt is configured to adjust an initial position of the spool of the first valve so that a superheat degree of the suction fluid can for example be adjusted.

Optionally, in the ejector, the spool of the first valve is connected to a spool of the second valve through a connecting rod, and a back side of the spool of the second valve is supported by a second elastic member; the second elastic member is connected to the housing of the ejector by a second bolt, and the second bolt is configured to adjust an initial position of the spool of the second valve.

Optionally, in the ejector, the high-pressure fluid passage includes a high-pressure fluid nozzle, the suction fluid passage includes a suction chamber surrounding the high-pressure fluid nozzle, and the thermal bulb is disposed in the suction chamber or at a position near an inlet of the suction chamber.

Optionally, in the ejector, the high-pressure fluid nozzle includes a constricted section, a throat portion, and a diffusion section in sequence, and the high-pressure fluid nozzle further includes a needle valve at the throat portion.

Optionally, in the ejector, the mixing chamber includes a constricted section, a neck section, and a diffusion section in sequence.

Optionally, in the ejector, a fluid in the closed cavity is a saturated refrigerant having substantially the same composition as the suction fluid.

Optionally, in the ejector, the thermal bulb is arranged in or outside the suction fluid passage, and the thermal bulb is in communication with the closed cavity via a conduit.

A refrigeration system is further provided, which includes the ejector according to various embodiments.

Optionally, the refrigeration system includes a single ejector or a plurality of ejectors connected in parallel.

Optionally, in the refrigeration system, the high-pressure fluid inlet of the ejector is connected to an outlet of a compressor via an optional regenerator, and a heat exchanger, the suction fluid inlet of the ejector is connected to an evaporator, and an outlet of the ejector is connected to a separator.

Optionally, the refrigeration system includes: a medium-temperature compressor, an outlet of which is connected to the high-pressure fluid inlet of the ejector via the heat exchanger and the optional regenerator; and a gas-liquid separator, wherein mixed fluid outlets of the plurality of ejectors are connected to the gas-liquid separator, a gas-phase outlet of the gas-liquid separator is connected to an inlet of the medium-temperature compressor, and a liquid-phase outlet of the gas-liquid separator is connected to suction fluid inlets of the plurality of ejectors via a medium-temperature expansion valve and a medium-temperature evaporator.

Optionally, in the refrigeration system, the liquid-phase outlet of the gas-liquid separator is further connected to an inlet of a low-temperature compressor via a low-temperature expansion valve and a low-temperature evaporator, and an outlet of the low-temperature compressor is connected to the inlet of the medium-temperature compressor.

BRIEF DESCRIPTION OF THE DRAWINGS

The contents of the present disclosure will become easier to understand with reference to the accompanying drawings. It can be easily understood by those skilled in the art that the drawings are merely used for illustration, and are not intended to limit the scope of protection of the present disclosure. In addition, like parts are denoted by like numerals in the drawings, wherein.

DETAILED DESCRIPTION OF THE EMBODIMENT(S) OF THE INVENTION

It will be readily understood that, based on the technical solutions of the present disclosure, those skilled in the art can propose various alternative structural forms and implementations without departing from the true spirit of the present disclosure. Therefore, the following specific embodiments and the accompanying drawings are merely exemplary description of the technical solutions of the present disclosure, which shall not be deemed as the entirety of the present disclosure or as limiting or restricting the technical solutions of the present disclosure.

Such orientation terms as "upper", "lower", "left", "right", "front", "rear", "front side", "back side", "top", "bottom" or the like that are mentioned or may be mentioned in this description are defined with respect to the configurations shown in the individual drawings. They are relative concepts and thus possibly vary according to their different locations or different states of use. Therefore, these or other orientation terms shall not be interpreted as limiting terms.

Figure 1:
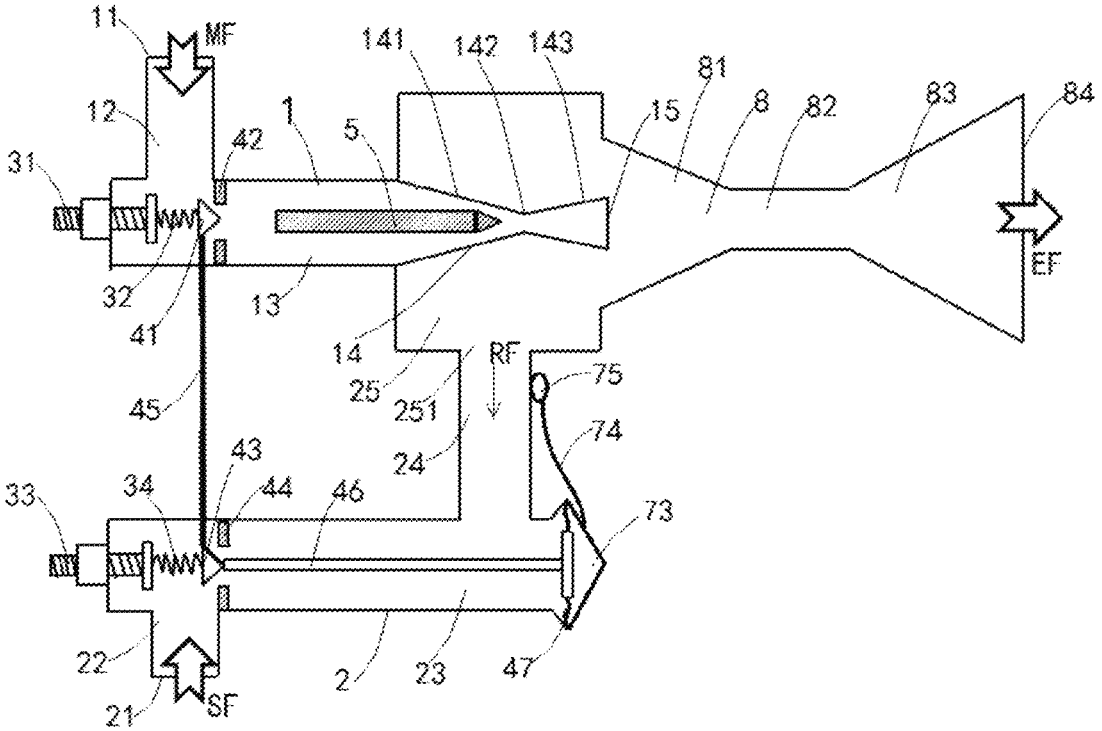
FIG. 1 is a schematic structural view of an ejector according to an embodiment of the present disclosure.

Referring first to FIG. 1, an internal structure of an ejector according to an embodiment of the present disclosure is shown. The ejector includes: a high-pressure fluid passage 1 extending from a high-pressure fluid inlet 11 to a mixing chamber 8; a suction fluid passage 2 extending from a suction fluid inlet 21 to the mixing chamber 8, a first valve being disposed in the suction fluid passage 2; the mixing chamber 8, which includes a mixed fluid outlet 84; and a thermal bulb 75 arranged downstream of the first valve in the suction fluid passage 2; wherein an elastic diaphragm 47 is disposed in the suction fluid passage, the suction fluid passage 2 is on a first side of the elastic diaphragm, and a closed cavity 73 is on a second side of the elastic diaphragm 47; the thermal bulb 75 is in communication with the closed cavity 73, and the thermal bulb 75 and the closed cavity 73 are filled with fluid; and the elastic diaphragm 47 is associated with the first valve so that the first valve is opened or closed in response to a change in a pressure difference across two sides of the elastic diaphragm. An advantage of the ejector according to the embodiment of the present disclosure is that the entire anti-reverse flow system can be implemented by using a mechanical structure without external electronic control, and the anti-reverse flow system can automatically prevent a reverse flow and has a high stability.

The high-pressure fluid passage 1 is configured to receive a fluid MF having a higher pressure, such as a 90 bar refrigerant fluid, from an outlet of a compressor for example. The fluid MF will be further accelerated when passing through the high-pressure fluid passage 1, whereby a fluid at the suction fluid inlet 21 is suctioned and mixed with the fluid MF. In the illustrated embodiment, the high-pressure fluid passage 1 may include a high-pressure fluid inlet 11, a first section 12, a second section 13, and a high-pressure fluid nozzle 14 in sequence. In some embodiments, the second section 13 may be perpendicular to the first section 12. In some embodiments, the high-pressure fluid nozzle 14 may include a constricted section 141 having a gradually decreasing cross-sectional area, a throat portion 142 having a minimum cross-sectional area, and a diffusion section 143 having a gradually increasing cross-sectional area. The high-pressure fluid nozzle 14 may further include a needle valve 5 at the throat portion 142, and the needle valve 5 may be operated by, for example, a stepper motor to control the flow of the high-pressure fluid ejected from the nozzle. In an alternative embodiment, the high-pressure fluid passage 1 may have any other suitable structure. In an alternative embodiment, the high-pressure fluid nozzle 14 may have other suitable structures. The high-pressure fluid is accelerated after passing through the nozzle, for example to a supersonic speed.

The suction fluid passage 2 is configured to receive a suction fluid SF having a lower pressure, such as 30 bar, from an outlet of an evaporator for example. In some embodiments, the suction fluid passage 2 may include a suction fluid inlet 21, a first section 22, a second section 23, a third section 24, and a suction chamber 25. In some embodiments, the second section 23 may be perpendicular to the first section 22, and the third section 24 may be perpendicular to the second section 23. In an alternative embodiment, the suction fluid passage 2 may have any suitable structure. In the illustrated embodiment, the suction chamber 25 surrounds the high-pressure fluid nozzle 14. In some embodiments, the high-pressure fluid MF and the suction fluid SF are mixed after entering the mixing chamber 8, and the mixing chamber 8 may, for example, include a constricted section 81 having a gradually decreasing cross-sectional area, a neck section 82 having a substantially constant cross-sectional area, a diffusion section 83 having a gradually increasing cross-sectional area and an outlet 84 of mixed fluids in sequence. In an alternative embodiment, the mixing chamber 8 may have other layouts. The mixed fluids EF exiting from the mixed fluid outlet 84 may have a higher pressure (such as 35 bar) than the suction fluid SF, and the mixed fluids EF may be provided to the inlet of the compressor, thereby supplying a fluid having a higher pressure to the compressor, and reducing the requirements on the capacity of the compressor.

When this type of ejector is operating, if the fluid cannot exit from the mixed fluid outlet 84 due to the low pressure at the suction fluid, a reverse flow RF from the mixing chamber 8 to the suction chamber 25 may be generated. This type of reverse flow usually occurs when the pressure outside the mixed fluid outlet is too high, for example, if the fluid pressures at the outlets of some ejectors are lower than other ejectors when a plurality of ejectors are connected in parallel, or if the downstream pressure is too high. The generation of the reverse current RF will lead to a reduction in system efficiency, damage the user experience, and even cause system shut-down.

In the embodiment of the present disclosure, the reverse flow problem is solved by the first valve arranged in the suction fluid passage 2, the elastic diaphragm 47 associated with the first valve, the closed cavity 73 and the thermal bulb 75. Specifically, the first valve may have a valve seat 44 and a spool 43. The thermal bulb 75 is arranged at a position downstream of the first valve in the suction fluid passage 2. For example, in the illustrated embodiment, the thermal bulb 75 is arranged at a position near the inlet of the suction chamber 25, where the suction chamber 25 is connected to the upstream pipe (i.e., the third section 24). The elastic diaphragm 47 is disposed in the suction fluid passage 2. In this embodiment, the elastic diaphragm 47 is disposed at a distal end of the second section 23 of the suction fluid passage 2. The suction fluid passage 2 is on a first side of the elastic diaphragm 47, and the closed cavity 73 is on a second side of the elastic diaphragm 47. In fact, it may also be considered that a part of the suction fluid passage 2 is partitioned by the elastic diaphragm 47 so that the closed cavity 73 is formed. The thermal bulb 75 is in communication with the closed cavity 73, for example by means of a conduit 74, and the thermal bulb 75 and the closed cavity 73 are filled with fluid. The elastic diaphragm 47 is associated with the first valve, so that the first valve is opened or closed in response to a change in a pressure difference across two sides of the elastic diaphragm 47. When a reverse flow RF occurs at the position of the thermal bulb 75, due to the existence of the two-phase refrigerant, a superheat degree of the refrigerant at the thermal bulb 75 will decrease, and a difference in the pressure of the fluid in the thermal bulb 75 and the closed cavity 73 and that of the fluid in the second section 23 of the suction fluid passage 2 will decrease, so the elastic diaphragm 47 will move to the right in the figure. Since the spool 43 is associated with the elastic diaphragm 47, the spool 43 will also move to close the first valve, thereby suppressing the reverse flow RF. In the illustrated embodiment, the elastic diaphragm 47 is connected to a front side of the spool 43 of the first valve through a connecting rod 46 for example, and the spool 43 of the first valve, such as a back side of the spool 43, may be supported by a first elastic member 34. The first elastic member 34 is connected to the housing of the suction fluid passage 2 of the ejector by a first bolt 33. Alternatively, the first elastic member 34 and the connecting rod 46 may be located on the same side of the spool 43. In addition, in an alternative embodiment, any suitable mechanical structure may be used to associate the elastic diaphragm with the first valve. The first bolt 33 can be configured to adjust an initial position of the spool of the first valve, thereby adjusting the superheat degree of the suction fluid. In a specific device, the first elastic member 34 having an appropriate elastic coefficient may be selected and the initial position of the first bolt 33 may be set according to the characteristics of the fluid in the thermal bulb and the closed cavity 73, thereby effectively preventing the reverse flow RF.

In some embodiments, a second valve may be disposed in the high-pressure fluid passage 1, and the second valve is mechanically connected to the first valve so that it is opened or closed in synchronization with the first valve. In the illustrated embodiment, the second section 13 of the high-pressure fluid passage 1 and the second section 23 of the suction fluid passage 2 may be disposed in parallel, and the second valve and the first valve are respectively disposed in the second section 13 of the high-pressure fluid passage 1 and the second section 23 of the suction fluid passage 2. Similar to the first valve, the second valve also includes a valve seat 42 and a spool 41. The spool 41 is supported by a second elastic member 32 and is mounted to the housing of the high-pressure fluid passage 1 through a second bolt 31. The second bolt 31 may be configured to adjust an initial position of the spool of the second valve. The second valve is mechanically connected to the first valve, such as by a connecting rod 45 or by other suitable mechanical means. Therefore, in case of an occurrence of a reverse flow, the second valve in the high-pressure fluid passage is also closed in response to the closing of the first valve, thereby stopping entering of the high-pressure fluid into the ejector.

In the embodiment shown in FIG. 1, the thermal bulb 75 is disposed in the third section 24 of the suction fluid passage 2 at a position close to the inlet of the suction chamber 25. It should be understood that in an alternative embodiment, the thermal bulb 75 may be disposed at any position downstream of the first valve of the suction fluid passage 2, such as at a position of the second section 23 of the suction fluid passage 2 downstream of the first valve, at the third section 24 or in the suction chamber 25. Disposing the thermal bulb 75 at the inlet of the suction chamber 25 enables the reverse flow RF to be sensed immediately, thereby improving the sensitivity of the device. In addition, the thermal bulb 75, the conduit 74, and the closed cavity 73 may be filled with any suitable fluid; for example, the fluid may be composed of a saturated refrigerant having the same or similar compositions as the fluid SF in the suction fluid passage. Optionally, the thermal bulb 75 may include a saturated refrigerant and other compositions such as an inert gas. In the illustrated embodiment, the thermal bulb 75 and the conduit 74 are arranged outside the suction fluid passage 2. In this case, the thermal bulb 75 and the conduit 74 may be appropriately wrapped and heat insulated. In an alternative embodiment, the thermal bulb 75 may be disposed in the suction fluid passage 2, and the conduit 74 may also be disposed in the suction fluid passage 2.

Figure 2:
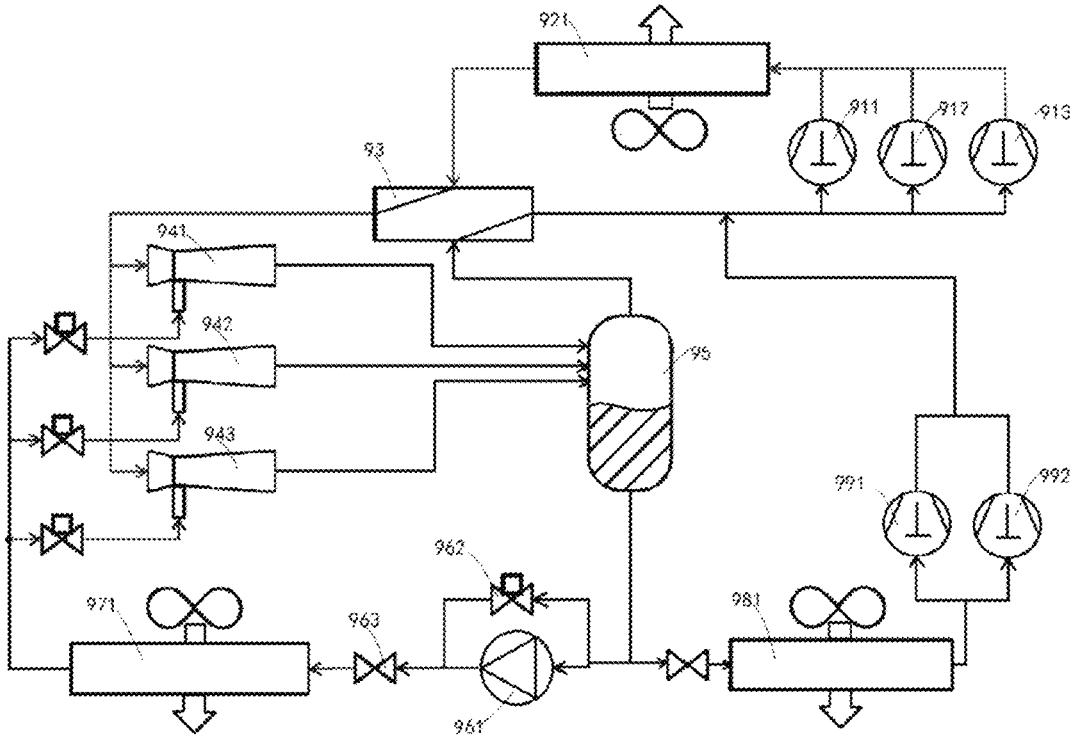
FIG. 2 is a schematic structural view of a refrigeration system to which the ejector according to an embodiment of the present disclosure is applied.

The present disclosure also provides a refrigeration system including the ejector according to various embodiments of the present disclosure. With continued reference to FIG. 2, a refrigeration system to which an embodiment of the present disclosure is applied will be described; for example, a commercial refrigerating cabinet is taken as an example. In some embodiments, the refrigeration system may include a plurality of ejectors 941,942 and 943 connected in parallel, and in an alternative embodiment, only one ejector may be provided. The high-pressure fluid inlet of each ejector is connected to outlets of compressors 911, 912 and 913, and a heat exchanger 921 and an optional regenerator 93 may be disposed therebetween. The heat exchanger 921 may be for example a condenser or an air cooler. In this embodiment, the compressors 911,912 and 913 may be medium-temperature compressors. The medium-temperature compressors 911,912 and 913 are connected to the high-pressure fluid inlets of each ejector 941,942 and 943 via the heat exchanger 921 and the optional regenerator 93. In the regenerator 93, the fluid can exchange heat with a gas-phase fluid of a separator 95. In addition, the mixed fluid outlet of each ejector 941,942 and 943 is in communication with the separator 95. The gas phase of the separator 95 leads to the inlets of the medium-temperature compressors 911,912 and 913 through the optional regenerator 93, and the liquid phase of the separator 95 enters an evaporator 971 through an optional booster pump 961 or a bypass passage 962 and a medium-temperature expansion valve 963, and then enters the suction fluid inlet of each ejector 941,942 and 943. In addition, in an alternative embodiment, a portion of the liquid-phase fluid of the gas-liquid separator 95 may also flow to inlets of low-temperature compressors 991 and 992 through a low-temperature expansion valve and a low-temperature evaporator 981, and outlets of the low-temperature compressors are connected to the inlets of the medium-temperature compressor 911,912 and 913. In an alternative embodiment, the ejector according to various embodiments may also be applied to other types of refrigeration devices.

The specific embodiments described above are merely for describing the principle of the present disclosure more clearly, and various components are clearly illustrated or depicted to make it easier to understand the principle of the present disclosure. Those skilled in the art can readily make various modifications or changes to the present disclosure without departing from the scope of the present disclosure. Therefore, it should be understood that these modifications or changes should be included within the scope of protection of the present disclosure.

What is claimed is:

1. An ejector for use in a refrigeration system, comprising:

a mixing chamber comprising a mixed fluid outlet;

a high-pressure fluid passage extending from a high-pressure fluid inlet to the mixing chamber;

a suction fluid passage extending from a suction fluid inlet to the mixing chamber, a first valve being disposed in the suction fluid passage; and a thermal bulb arranged in the suction fluid passage downstream of the first valve;

wherein an elastic diaphragm is disposed in the suction fluid passage, the suction fluid passage is on a first side of the elastic diaphragm, and a closed cavity is on a second side of the elastic diaphragm; the thermal bulb is in communication with the closed cavity, and the thermal bulb and the closed cavity are filled with fluid; and the elastic diaphragm is associated with the first valve so that the first valve is opened or closed in response to a change in a pressure difference across two sides of the elastic diaphragm;

wherein the elastic diaphragm is connected to a spool of the first valve, and the spool of the first valve is further supported by a first elastic member; the first elastic member is connected to a housing of the ejector by a first bolt, and the first bolt is configured to adjust an initial position of the spool of the first valve so that a superheat degree of the suction fluid is adjusted;

wherein the spool of the first valve is connected to a spool of a second valve through a connecting rod, and the spool of the second valve is supported by a second elastic member; the second elastic member is connected to the housing of the ejector by a second bolt, and the second bolt is configured to adjust an initial position of the spool of the second valve.

2. An ejector for use in a refrigeration system, comprising:

a mixing chamber comprising a mixed fluid outlet;

a high-pressure fluid passage extending from a high-pressure fluid inlet to the mixing chamber;

a suction fluid passage extending from a suction fluid inlet to the mixing chamber, a first valve being disposed in the suction fluid passage; and a thermal bulb arranged in the suction fluid passage downstream of the first valve;

wherein an elastic diaphragm is disposed in the suction fluid passage, the suction fluid passage is on a first side of the elastic diaphragm, and a closed cavity is on a second side of the elastic diaphragm; the thermal bulb is in communication with the closed cavity, and the thermal bulb and the closed cavity are filled with fluid; and wherein the elastic diaphragm is associated with the first valve so that the first valve is opened when a superheat degree of a refrigerant in the suction fluid passage at the thermal bulb increases, or the first valve is closed when the superheat degree of the refrigerant in the suction fluid passage at the thermal bulb decreases, in response to a change in a pressure difference across two sides of the elastic diaphragm.

3. The ejector according to claim 2, wherein the elastic diaphragm is connected to a spool of the first valve, and the spool of the first valve is further supported by a first elastic member; the first elastic member is connected to a housing of the ejector by a first bolt, and the first bolt is configured to adjust an initial position of the spool of the first valve so that a superheat degree of the suction fluid is adjusted.

4. The ejector according to claim 2, wherein the high-pressure fluid passage comprises a high-pressure fluid nozzle, the high-pressure fluid nozzle comprises a constricted section, a throat portion, and a diffusion section in sequence, and the high-pressure fluid nozzle further comprises a needle valve at the throat portion; the suction fluid passage comprises a suction chamber surrounding the high-pressure fluid nozzle, and the thermal bulb is disposed in the suction chamber or at a position near an inlet of the suction chamber; and the mixing chamber comprises a constricted section, a neck section, and a diffusion section in sequence.

5. The ejector according to claim 2, wherein the fluid in the closed cavity is a saturated refrigerant having substantially the same composition as the suction fluid.

6. The ejector according to claim 2, wherein the thermal bulb is arranged in or outside the suction fluid passage, and the thermal bulb is in communication with the closed cavity via a conduit.

7. The ejector according to claim 2, wherein a second valve is disposed in the high-pressure fluid passage, and the first valve and the second valve are configured to be opened or closed in synchronization with each other.

8. The ejector according to claim 7, wherein the high-pressure fluid passage and the suction fluid passage comprise parallel sections that are parallel to each other, and the first valve and the second valve are respectively disposed in the parallel sections of the suction fluid passage and the high-pressure fluid passage.

9. A refrigeration system, comprising the ejector according to claim 2.

10. The refrigeration system according to claim 9, wherein the refrigeration system comprises a single ejector or a plurality of ejectors connected in parallel.

11. The refrigeration system according to claim 10, comprising:

a medium-temperature compressor, an outlet of which is connected to the high-pressure fluid inlet of the ejector via a heat exchanger and an optional regenerator; and a gas-liquid separator, wherein mixed fluid outlets of the plurality of ejectors are connected to the gas-liquid separator, a gas-phase outlet of the gas-liquid separator is connected to an inlet of the medium-temperature compressor, and a liquid-phase outlet of the gas-liquid separator is connected to suction fluid inlets of the plurality of ejectors via a medium-temperature expansion valve and a medium-temperature evaporator.

12. The refrigeration system according to claim 11, wherein the liquid-phase outlet of the gas-liquid separator is further connected to an inlet of a low-temperature compressor via a low-temperature expansion valve and a low-temperature evaporator, and an outlet of the low-temperature compressor is connected to the inlet of the medium-temperature compressor.

* * * * *